United States Patent [19]

Compton

[11] 4,086,963

[45] May 2, 1978

[54] METHOD OF OXIDIZING HYDROGEN SULFIDE

[75] Inventor: Leslie E. Compton, Claremont, Calif.

[73] Assignee: Occidental Oil Shale, Inc., Grand Junction, Colo.

[21] Appl. No.: 780,927

[22] Filed: Mar. 24, 1977

[51] Int. Cl.[2] ..... E21B 43/24; E21B 43/26; E21C 41/10; B01J 8/02

[52] U.S. Cl. ..... 166/259; 166/266; 166/270; 299/2; 423/224; 423/244

[58] Field of Search ..... 166/244 C, 251, 256, 166/259, 261, 265, 266, 270; 299/2; 48/197 R; 208/11 R; 423/224, 230, 242, 244

[56] References Cited

U.S. PATENT DOCUMENTS

| | | | |
|---|---|---|---|
| 1,479,852 | 1/1924 | Engelhardt | 423/224 |
| 2,581,135 | 1/1952 | Odell | 423/224 |
| 2,812,288 | 11/1957 | Lankford et al. | 208/11 R X |
| 3,072,187 | 1/1963 | Carr | 166/261 X |
| 3,454,958 | 7/1969 | Parker | 166/256 |
| 3,548,938 | 12/1970 | Parker | 166/256 |
| 3,551,093 | 12/1970 | Myers | 423/244 |
| 3,578,080 | 5/1971 | Closmann | 166/259 X |
| 3,661,423 | 5/1972 | Garret | 299/2 |
| 4,005,752 | 2/1977 | Cha | 166/261 X |
| 4,014,575 | 3/1977 | French et al. | 166/256 |

*Primary Examiner*—Stephen J. Novosad
*Assistant Examiner*—George A. Suchfield
*Attorney, Agent, or Firm*—Christie, Parker & Hale

[57] ABSTRACT

The hydrogen sulfide concentration of a gas is reduced by reacting hydrogen sulfide in the gas with oxygen in the presence of raw oil shale. The ratio of sulfur dioxide to sulfur produced by this reaction depends upon the molar ratio of oxygen to hydrogen sulfide present. Sulfur is the predominant product when hydrogen sulfide is reacted in the presence of oil shale with less than about 1 mole of oxygen for each 2 moles of hydrogen sulfide.

18 Claims, 2 Drawing Figures

METHOD OF OXIDIZING HYDROGEN SULFIDE

CROSS REFERENCES

Figure 1:
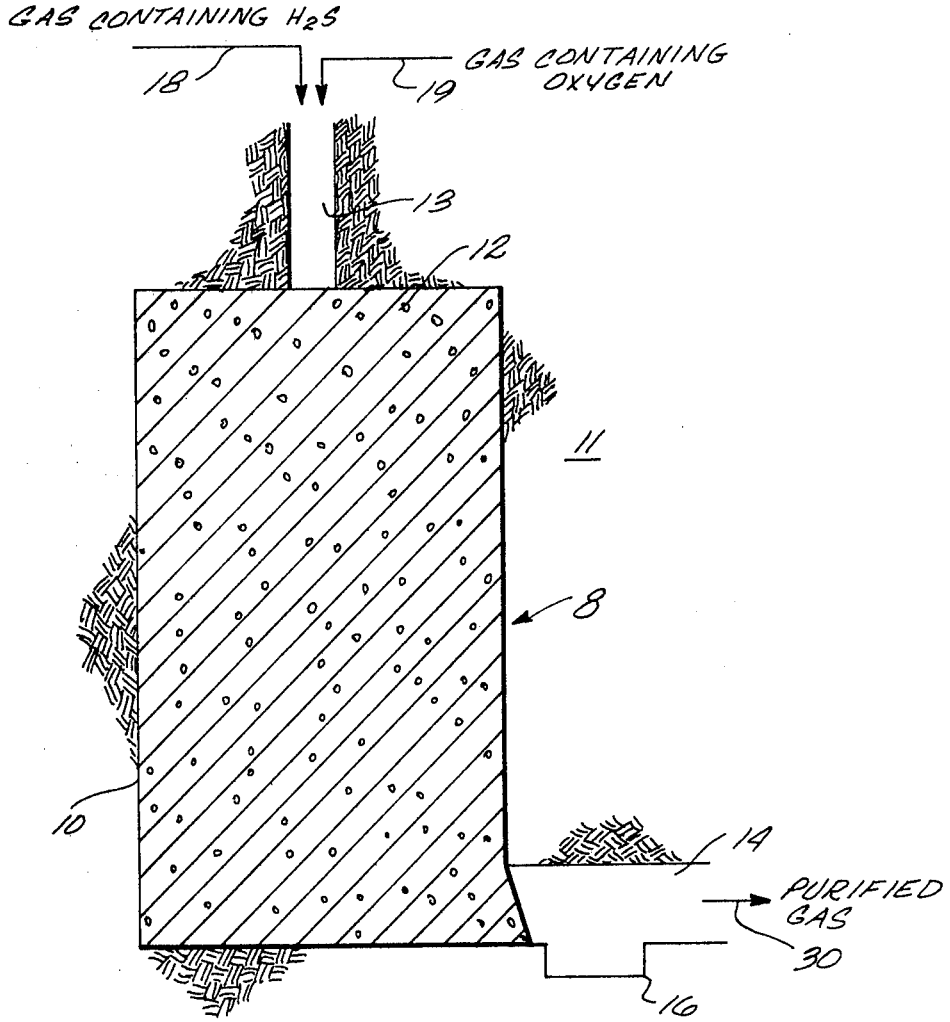

This application is related to U.S. patent application Ser. No. 780,928 filed on Mar. 24, 1977, entitled Low Temperature Oxidiation of Hydrogen Sulfide in the Presence of Oil Shale, and filed by Leslie E. Compton and William H. Rowan; and U.S. patent application Ser. No. 780,924, filed on Mar. 24, 1977, entitled Decreasing Hydrogen Sulfide Concentration Of A Gas, and filed by Chang Yul Cha. Each of these two patent applications is incorpoorated herein by reference.

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposite interspersed with layers containing an organic polymer called "kerogen", which upon heating decomposes to produce carbonaceous liquid and gaseous products. It is the formation containing kerogen that is called "oil shale" herein, and the liquid product is called "shale oil". A number of methods have been developed for processing the oil shale which involve either first mining the kerogen bearing shale and processing the shale on the surface, or processing the shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972 to Donald E. Garrett, assigned to the assignee of this application and incorporated herein by reference. This patent describes in situ recovery of liquid and gaseous carbonaceous materials from a subterranean formation containing oil shale by explosively expanding and fragmenting such formation to form a stationary, fragmented, permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing "retorted oil shale".

One method of supplying hot retorting gases used for converting kerogen contained in the oil shale, as described in U.S. Pat. No. 3,661,423, includes establishment of a combustion zone in the retort and movement of an oxygen supplying gaseous feed mixture as a combustion zone feed downwardly into the combustion zone to advance the combustion zone downwardly through the retort. In the combustion zone oxygen in the gaseous feed mixture is depleted by reaction with hot carbonaceous materials to produce heat and a combustion gas. By the continued introduction of the oxygen supplying gaseous feed mixture downwardly into the combustion zone, the combustion zone is advanced downwardly through the retort.

The combustion gas and the portion of the gaseous feed mixture which does not take part in the combustion process pass through the retort on the advancing side of the combustion zone to heat the oil shale in a retorting zone to a temperature sufficient to produce kerogen decomposition, called retorting, in the oil shale to gaseous and liquid products and a residue product of solid carbonaceous material.

The liquid products and gaseous products are cooled by the cooler oil shale fragments in the retort on the advancing side of the retorting zone. The liquid carbonaceous products, together with water produced in or added to the retort, are collected at the bottom of the retort. An off gas containing combustion gas generated in the combustion zone, product gas produced in the retorting zone, gas from carbonate decomposition, and gaseous feed mixture which does not take part in the combustion process is also withdrawn at the bottom of the retort.

The off gas, which contains nitrogen, hydrogen, carbon monoxide, carbon dioxide, methane, water vapor, hydrocarbons, and hydrogen sulfide, can be used as a fuel or otherwise disposed of, but should first be purged of the hydrogen sulfide, which is a pollutant. The hydrogen sulfide, which can be present in the off gas at concentrations in the range of 1500 to 3000 parts per million (ppm) by volume, is generated from naturally occurring sulfur compounds in oil shale during the heating and combustion in the in situ oil shale retort.

Hydrogen sulfide is an extremely toxic gas with a toxicity greater than that of hydrogen cyanide. It also possesses a powerful, objectionable odor with a threshold for human smell of about 0.0003 ppm. For these reasons emission standards for hydrogen sulfide have been established in many states, including states having oil shale deposits. Thus various processes for the removal of hydrogen sulfide from gases such as off gas from oil shale retorting have been devised. These processes generally involve absorption of hydrogen sulfide into a liquid such as alkanolamine or high temperature liquid carbonate solutions, absorption of hydrogen sulfide onto a solid such as iron oxide pellets, and catalytic or noncatalytic oxidation of hydrogen sulfide to sulfur and/or sulfur dioxide such as in the Claus process.

A problem with absorption and adsorption processes is that the agent used for absorbing or adsorbing must, after use, be chemically regenerated or disposed of and replaced. Either of these alternatives can be expensive. A problem with noncatalytic oxidation is that high temperatures may be required which can result in oxidation of the hydrocarbon and carbon monoxide constituents of the off gas, thereby substantially reducing the heating value of the off gas. Even with catalytic oxidation, temperatures can be so high that substantial reduction in the heating value of the off gas occurs. Another problem with catalytic oxidation is that the catalyst eventually becomes poisoned, thereby exhibiting reduced activity, and must then either be chemically regenerated or disposed of and replaced.

Thus there is a need for an economical method for removing hydrogen sulfide from a gas stream, such as the off gas from an in situ oil shale retort, where the method does not substantially reduce the heating value of the gas stream.

SUMMARY OF THE INVENTION

According to the method of this invention the hydrogen sulfide concentration of a gas is reduced by introducing a gas containing a first, relatively higher hydrogen sulfide concentration to a fragmented permeable mass of raw oil shale. Hydrogen sulfide in the gas is reacted with oxygen in the presence of the raw oil shale to yield gas containing a second, relatively lower hydrogen sulfide concentration. The oil shale promotes the oxidation of the hydrogen sulfide. Such gas with relatively lower hydrogen sulfide concentration is withdrawn from the fragmented permeable mass of raw oil shale.

This method is effective for reducing the hydrogen sulfide concentration of off gas from an in situ oil shale retort. When gas containing fuel value components such as off gas from an in situ oil shale retort is the gas containing relatively higher hydrogen sulfide concentration, preferably oil shale contacted by the fuel value components is at a temperature less than the spontaneous ignition temperature of the fuel value components at the conditions at which the oil shale is contacted by the fuel value components.

The ratio of sulfur dioxide to sulfur produced by reacting hydrogen sulfide with oxygen in the presence of raw oil shale depends upon the molar ratio of oxygen to hydrogen sulfide present. Sulfur is the predominant product when hydrogen sulfide is reacted in the presence of oil shale with less than about one mole of oxygen for each two moles of hydrogen sulfide.

DRAWINGS

Figure 2:
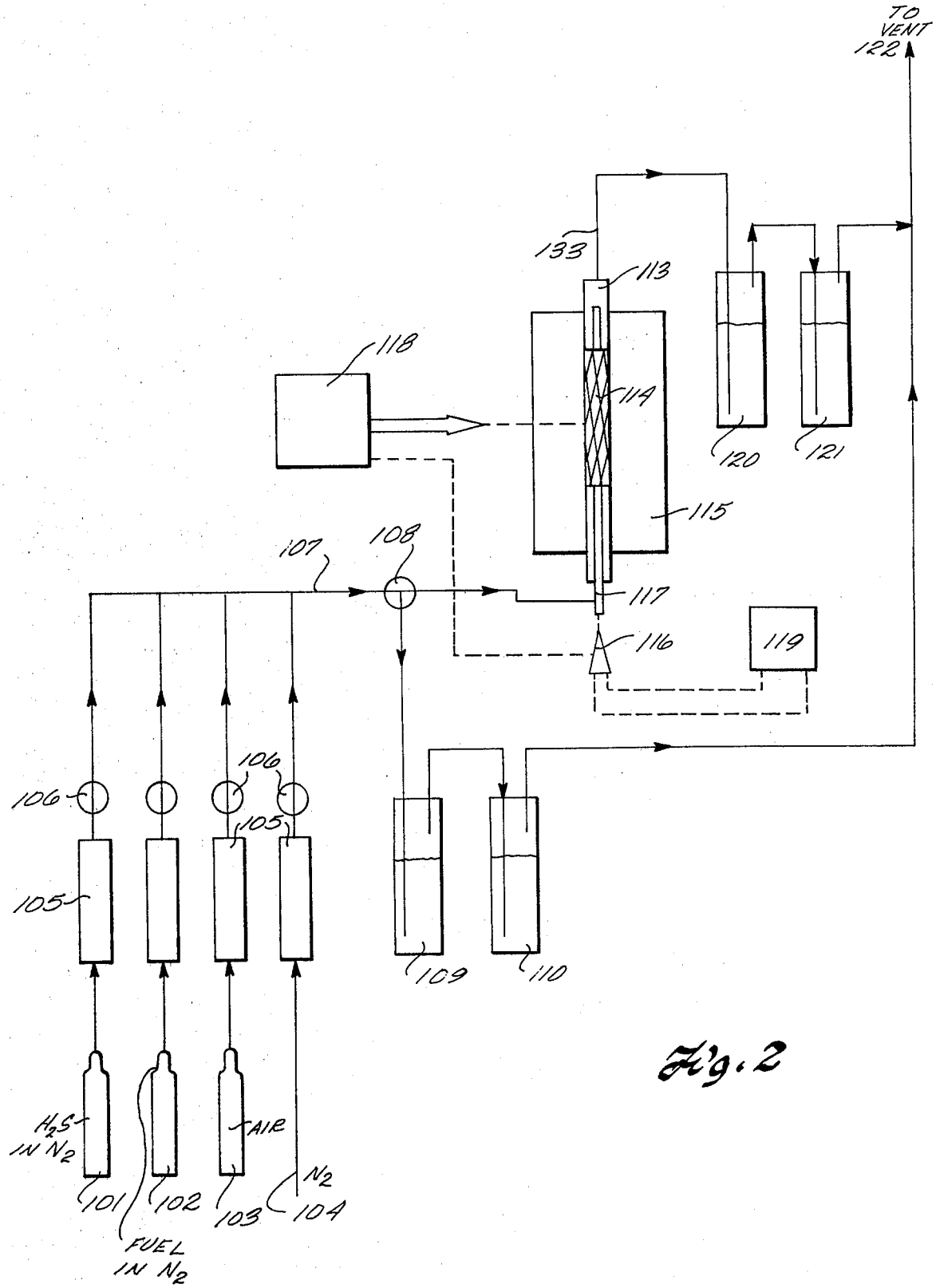

These and other features, aspects and advantages of the present invention will become more apparent with respect to the following description, appended claims, and accompanying drawings where:

FIG. 1 schematically represents in vertical cross section an in situ oil shale retort containing combusted oil shale being used for oxidizing hydrogen sulfide contained is a gas stream; and FIG. 2 schematically represents apparatus used for demonstrating the efficacy of the method of this invention.

DESCRIPTION

Referring to FIG. 1, in an embodiment of this invention, an in situ oil shale retort 8 is in the form of a cavity 10 formed in an unfragmented subterranean formation 11 containing oil shale. The cavity contains an expanded or fragmented permeable mass 12 of formation particles. The cavity 10 can be created simultaneously with fragmentation of the mass of formation particles 12 by blasting by any of a variety of techniques. A method of forming an in situ oil retort is described in U.S. Pat. No. 3,661,423.

A conduit 13 communicates with the top of the fragmented mass of formation particles. During the retorting operation of the retort 8, a combustion zone is established in the retort and advanced by introducing a gaseous feed containing an oxygen supplying gas, such as air or air mixed with other gases, into the in situ oil shale retort through the conduit 13. As the gaseous feed is introduced to the retort, oxygen oxidizes carbonaceous material in the oil shale to produce combusted oil shale and combustion gas. Heat from the exothermic oxidation reactions carried by flowing gases advances the combustion zone through the fragmented mass of particles.

Combustion gas produced in the combustion zone, any unreacted portion of the oxygen supplying gaseous feed and gases from carbonate decomposition are passed through the fragmented mass of particles on the advancing side of the combustion zone to establish a retorting zone on the advancing side of the combustion zone. As oil shale is retorted in the retorting zone, kerogen is converted to liquid and gaseous products.

There is a drift 14 in communication with the bottom of the retort. The drift contains a sump 16 in which liquid products are collected to be withdrawn for further processing. An off gas containing gaseous products, combustion gas, gases from carbonate decomposition, and any unreacted portion of the oxygen supplying gaseous feed is also withdrawn from the in situ oil shale retort 8 by way of the drift 14. The off gas can contain large amounts of nitrogen with lesser amounts of hydrogen, carbon monoxide, carbon dioxide, methane, higher hydrocarbons, water vapor, and sulfur compounds such as hydrogen sulfide. The off gas also can contain particulates and hydrocarbon containing aerosols. It is desirable to remove at least a portion of the hydrogen sulfide from the off gas so the off gas can be used as fuel gas for power generation in a work engine such as a gas turbine, or if the off gas is flared, to limit the sulfurous emission.

The retort illustrated in FIG. 1 has not yet had retorting and combustion operations completed. The retort contains a fragmented permeable mass of formation particles containing raw oil shale. As used herein, the term "raw oil shale" refers to oil shale which has not been subjected to any processing affecting the chemical composition of the oil shale.

A gas stream 18 containing hydrogen sulfide, such as off gas from an active oil shale retort, and a gas stream 19 containing oxygen, such as air, are introduced concurrently through the conduit 13 to the retort 8. There is sufficient differential pressure between the top and bottom of the retort to cause the gas streams to flow through the conduit 13, which is in communication with the upper boundary of the fragmented mass of raw oil shale particles in the retort 8, and downwardly as one combined gas stream through the retort 8 to be withdrawn from the retort through the tunnel 14 which is in communication with the bottom of the retort. For economy, the conduit to be used for introducing oxygen supplying gaseous feed to the retort 8 during a retorting operation is utilized for introducing the gas streams 18, 19 into the retort. Similarly, the tunnel to be used for withdrawing off gas from the retort 8 during a retorting operation is utilized to withdraw purified gas from the retort.

When the hydrogen sulfide containing gas is off gas from an active oil shale retort, oil aerosols and/or particulates which can be contained in the off gas can be removed from the off gas prior to introduction into the retort. This is done to prevent deposition of oil and/or particulates on the fragmented mass of oil shale particles in the retort, which can reduce the activity of the particles in removing hydrogen sulfide from the off gas.

As the hydrogen sulfide containing gas stream 18 and the oxygen containing gas stream 19 pass through the retort, hydrogen sulfide is oxidized to sulfur dioxide and/or sulfur. Oxidation of hydrogen sulfide in contact with oil shale has been demonstrated to occur at appreciable rates even at temperatures as low as 75° F. This overall result is surprising because hydrogen sulfide is not oxidized at appreciable rates at temperatures less than its spontaneous ignition temperature of 550° F without use of a catalyst. It was not expected that raw oil shale would promote the oxidation of hydrogen sulfide. It has been found that the lower the temperature at which the hydrogen sulfide and oxygen are reacted, the higher the ratio of sulfur to sulfur dioxide at least initially produced by the oxidation reaction. At temperatures less than about 300° F, even at molar ratios of oxygen to hydrogen sulfide greater than 3:2, over 90% of the hydrogen sulfide is at least initially oxidized to form elemental sulfur. Even at temperatures as high as 450° F, over half the hydrogen sulfide oxidized is at least initially oxidized to elemental sulfur.

The hydrogen sulfide containing gas 18 can contain fuel value components such as when the gas is off gas from an in situ oil hale retort. Off gas from an in situ oil shale retort can contain fuel value components such as hydrogen, methane and other hydrocarbons, and carbon monoxide. To avoid oxidation of such fuel value components, preferably the formation particles contacted by the fuel value components are at a temperature less than their spontaneous ignition temperature. The spontaneous ignition temperature of the fuel value components is dependent upon the conditions at which the formation particles are contacted by the fuel value components, i.e. the spontaneous ignition temperature of fuel value components is dependent upon such process parameters as the total pressure and the partial pressure of oxygen and the fuel value components in the retort.

As the temperature at which hydrogen sulfide contacts oil shale in the presence of oxygen increases, the rate at which hydrogen sulfide contained in the gas stream 18 is oxidized to sulfur and sulfur dioxide increases with all other process conditions maintained constant. If there is insufficient residence time in the retort 8 to achieve a desired degree of conversion, the hydrogen sulfide and oxygen containing gases can be passed through additional retorts containing raw oil shale in series and/or parallel, or recirculated several times in a single retort to achieve maximum removal.

At temperatures greater than about 300° F, the molar ratio of oxygen reacted with hydrogen sulfide in the presence of oil shale affects the ratio of sulfur to sulfur dioxide produced. The higher the molar ratio of oxygen reacting with the hydrogen sulfide, the lower the resulting molar ratio of sulfur to sulfur dioxide from oxidation of hydrogen sulfide. This can be understood with reference to the stoichiometry of the following two reactions:

$$2H_2S + O_2 \rightarrow 2H_2O + S \quad (1)$$

$$2H_2S + 3O_2 \rightarrow 2H_2O + 2SO_2 \quad (2)$$

Thus at a molar ratio of oxygen to hydrogen sulfide of 1:2, all the hydrogen sulfide in a hydrogen sulfide containing gas can be converted to sulfur, and at a molar ratio of 3:2 all of the hydrogen sulfide can be converted to sulfur dioxide. Therefore by adjusting the ratio of oxygen to hydrogen sulfide introduced to the retort, the molar ratio of sulfur to sulfur dioxide produced from hydrogen sulfide should be controllable.

It should be understood that even at molar ratios of oxygen to hydrogen sulfide of 1:2 and lower, some sulfur dioxide results from the oxidation of hydrogen sulfide, thereby leaving some hydrogen sulfide unoxidized. Similarly, even at molar ratios of oxygen to hydrogen sulfide of 3:2 and greater, some sulfur is at least initially produced from the oxidation of the hydrogen sulfide.

An advantage of oxidizing hydrogen sulfide at a temperature less than 300° F and an oxygen to hydrogen sulfide molar ratio of about 1:2 or less is that production of elemental sulfur is favored. Therefore, the purified gas can contain a lower concentration of sulfur compounds than the hydrogen sulfide containing gas introduced into the retort because the elemental sulfur formed can deposit in the retort. Also, a portion of the deposited sulfur can be recovered and sold as a valuable commodity.

The sulfur dioxide and sulfur produced from the reaction of oxygen and hydrogen sulfide can combine with constituents of the oil shale to yield solid sulfur-containing materials such as pyrites.

It has been found that the percent of hydrogen sulfide oxidized by contacting oil shale in the presence of oxygen gradually decreases as the oil shale is exposed to hydrogen sulfide. However, it appears that percent conversion asymptotically approaches a constant effective level.

The gas stream 30 withdrawn from the retort has a relatively lower hydrogen sulfide concentration than the hydrogen sulfide containing gas 18 introduced into the retort 8 due to oxidation of hydrogen sulfide in the retort. It also can have a lower total sulfur compound content because of solid sulfur deposited on the mass of oil shale particles in the retort.

The hydrogen sulfide containing gas and oxygen supplying gas can be introduced separately into the retort, or can be substantially homogeneously mixed prior to introduction into the retort. Mixing can be accomplished by any of a number of methods. Mixing can be effected with devices such as jet mixers, injectors, fans and the like.

The hydrogen sulfide containing gas 18 can inherently contain sufficient oxygen that an oxygen containing gas is not required. For example, off gas from an in situ oil shale retort can contain 0.2% by volume oxygen and 0.16% by volume hydrogen sulfide. Thus off gas can inherently contain sufficient oxygen to oxidize 83% of the hydrogen sulfide contained therein to sulfur dioxide and water.

The method of this invention has many advantages over prior art processes described above. By using raw oil shale to remove hydrogen sulfide from gas streams such as off gas from an in situ oil shale retort, the purchase of a hydrogen sulfide absorbent or an adsorbent is avoided. Furthermore, when oil shale contained in an in situ oil shale retort is used, the oil shale remains in the ground, thereby eliminating disposal problems. In addition, vast quantities of oil shale are available. Thus regeneration of oil shale, even if its activity is greatly reduced by poisoning, is unnecessary. A long residence time of the hydrogen sulfide containing gas and gaseous source of oxygen can be utilized to achieve high conversion. Another advantage of the method of this invention is that fuel value components such as hydrogen, carbon monoxide and hydrocarbons contained in the hydrogen sulfide containing gas are not oxidized during the oxidation of the hydrogen sulfide because of the low temperatures used. To prevent such oxidation, preferably fuel value components in the hydrogen sulfide containing gas contact raw oil shale at a temperature less than the spontaneous ignition temperature of the fuel value components at the conditions at which the oil shale is contacted by the fuel value components. Therefore, the fuel value of the hydrogen sulfide containing gas is not significantly reduced.

It will be understood that although the "oxygen containing gas" is ordinarily ambient air, other composition variations are included within the term. Thus, for example, if desired, pure oxygen can be used or air can be augmented with additional oxygen so that the partial pressure of oxygen is increased. Similarly, air can be diluted with an oxygen free gas such as nitrogen.

Tests demonstrating the method of this invention are described in a paper entitled "Hydrogen Sulfide Removal from Retort Off Gases Using Oil Shale" authored by Leslie E. Compton and William R. Rowan. This paper, which is filed herewith in the United States Patent and Trademark Office, is incorporated herein by reference.

The following controls and examples demonstrate the efficacy of raw oil shale in promoting the oxidation of hydrogen sulfide at low temperatures.

CONTROLS 1 - 4

The apparatus for conducting controls 1-4 is shown in FIG. 2. Bottled gas was provided in three tanks 101, 102, and 103. Tank 101 contained 1.2 volume percent hydrogen sulfide in nitrogen. Tank 102 contained 27 volume percent $CO_2$, 4.5 volume percent $CH_4$, 2.9 volume percent $H_2$, and 4.2 volume percent CO in nitrogen. This is about the same ratio as these gases are present in off gas from an oil shale retort. Tank 103 contained air. Dry nitrogen was provided from line 104.

Gases from tanks 101, 103 and line 104 were metered with flow meters 105 and control valves 106 and blended together to form 0.0464 cfm (cubic feet per minute) at 75° F of a gas mixture in line 107 containing 18 volume percent oxygen 0.10 volume percent $H_2S$, and 71.9 volume percent nitrogen. The gas mixture in line 107 passed to a three way valve 108 where a portion was intermittently diverted to a first water trap 109, and then to a first sodium hydroxide trap 110 having a pH of 14. The first water trap 109 was used to determine the amount of hydrogen sulfide which dissolved in water at the gas compositions, flow rates, and trap configurations used. The first sodium hydroxide trap 110 was used to determine the inlet hydrogen sulfide concentration.

The gas mixture not diverted passed to a $\frac{7}{8}$ inch inner diameter quartz reactor 113 containing a bed 114 of oil shale particles. The temperature of the oil shale bed was maintained at a desired level with a single zone, one inch internal diameter electric furnace 115. Shale bed temperatures were scanned wiith a thermocouple probe 116 inserted in a thermo-well 117. The temperature in the bed was controlled by means of a temperature controller 118, and temperature was monitored with a temperature indicator 119.

Effluent gas from the shale bed passed via line 133 to a second set of water 120 and sodium hydroxide 121 traps, and then was vented through line 122 to a hood (not shown). Elemental sulfur formed by the oxidation of hydrogen sulfide departed in line 133.

The second water trap 120 served to remove sulfur dioxide from the reactor effluent and the second sodium hydroxide trap 121 removed unreacted hydrogen sulfide from the reactor effluent.

The sulfur content in the four traps was determined using a $KIO_3$ titration to a starch iodine end point. For the sodium hydroxide traps 110 and 121, the sample was acidified with hydrochloric acid prior to titration. The $SO_2$ concentration of the effluent gas as measured with the second water trap 120 was adjusted for the amount of $H_2S$ known to dissolve in the trap as determined with the first water trap 109.

For controls 1-4, seventy grams of 1 mm diameter glass beads were used in the reactor. The reactor temperature used for each control is listed in Table I. The traps were periodically sampled to determine the hydrogen sulfide content of the gas mixture 107 feed to the reactor and the hydrogen sulfide and sulfur dioxide content of the effluent from the reactor.

The percentage by weight of hydrogen sulfide removed from the feed, the percentage by weight of hydrogen sulfide converted to sulfur dioxide and the ratio of elemental sulfur to SO produced from the $H_2S$ are presented in Table I for one hour after initiation of feed to the pyrolysis reactor. The values in Table I assume that all hydrogen sulfide in the gas mixture feed to the reactor which is not in the effluent as sulfur dioxide or hydrogen sulfide was converted to elemental sulfur.

EXAMPLE 1

Using the apparatus of FIG. 2, a reactor feed gas mixture having a composition by volume of 28% $CO_2$, 5% CO, 4.5% $CH_4$, 4.2% $H_2$, 0.10% $H_2S$, 0.5% $O_2$ and the balance $N_2$ was introduced to the reactor 114 at a rate of 0.0464 cfm at 75° F. The reactor contained a 70 gram charge of $-3$ $+8$ mesh raw Colorado shale. The percent hydrogen sulfide removal was determined using the method described for controls 1-4 at 20, 60 and 100 minutes after initiation of feed to the reactor.

The results, which are presented in Table I, clearly show that raw shale was effective in promoting oxidation of hydrogen sulfide in the presence of oxygen. However, even at temperatures up to 500° F hydrogen sulfide was not oxidized by contacting glass beads in the presence of oxygen.

It was noted that no measurable amount of the carbon monoxide, methane, and hydrogen introduced into the quartz reactor was lost. This indicates that raw oil shale can be used to effectively remove hydrogen sulfide from a gas stream containing components having fuel value without deleteriously affecting the fuel value of the gas stream.

EXAMPLE 2

Off gas generated in an in situ oil shale retort at a rate of 1046 SCFM containing a varying concentration of hydrogen sulfide in the range of from 1500 to 3000 ppm by volume hydrogen sulfide is combined with 12.8 SCFM of air (molar ratio of $O_2$ to $H_2S$ of 3:2 at 3000 ppm $H_2S$ content of the off gas). The combined gas stream is introduced into the top of an in situ oil shale retort in the south/southwest portion of the Piceance Creek structural basin in Colorado. The retort contains a fragmented permeable mass of particles containing raw oil shale. The cross-sectional area of the retort is 1055 square feet and the retort is 113 feet high. Gas is withdrawn from the bottom of the retort. The withdrawn gas has a lower $H_2S$ concentration than the combined gas introduced to the retort.

Although this invention has been described in considerable detail with reference to certain versions thereof, other versions of the invention are within the scope of this invention. Thus the spirit and scope of the appended claims should not necessarily be limited to the description of the preferred embodiments.

TABLE I

| | Reactor Charge | Reactor Temperature °F | $H_2S$ Removal (%) Time (Min.) 20 | 60 | 100 |
|---|---|---|---|---|---|
| Control 1 | Glass Beads | 300 | — | 3 | — |
| Control 2 | Glass Beads | 400 | — | 0 | — |
| Control 3 | Glass Beads | 500 | — | 3 | — |
| Control 4 | Glass Beads | 650 | — | 48 | — |
| Example 1 | Raw Wyoming Shale | 300 | 52 | 30 | 15 |

What is claimed is:

1. A method for recovering gaseous products from a first in situ oil shale retort in a subterranean formation containing oil shale, said first in situ retort containing an explosively expanded and fragmented permeable mass of particles containing oil shale and having a combustion zone and a retorting zone advancing therethrough, the method comprising the steps of:

(a) introducing into the first in situ oil shale retort on the trailing side of the combustion zone a combustion zone feed comprising oxygen to advance the combustion zone through the fragmented mass of particles and produce combustion gases in the combustion zone;

(b) passing said combustion gases and any unreacted portion of the combustion zone feed through a retorting zone in the fragmented mass of particles on the advancing side of the combustion zone, wherein oil shale is retorted and gaseous products are produced;

(c) withdrawing an off gas comprising said gaseous products, combustion gases and any gaseous unreacted portions of the combustion zone feed, and including hydrogen sulfide, from the first in situ oil shale retort from the advancing side of the retorting zone; and (d) reducing the hydrogen sulfide concentrations of off gas by the steps of:

(i) introducing at least a portion of the off gas from the first retort into a second in situ oil shale retort in a subterranean formation containing oil shale, said second in situ retort containing a fragmented permeable mass of formation particles containing raw oil shale;

(ii) introducing oxygen containing gas into the second retort for reacting oxygen in the oxygen containing gas with hydrogen sulfide in the off gas in the presence of raw oil shale in the second retort to yield gas having a hydrogen sulfide concentration relatively lower than the hydrogen sulfide concentration of the off gas; and (iii) withdrawing from the second retort such gas having relatively lower hydrogen sulfide concentration.

2. A method of decreasing hydrogen sulfide concentration of a gas comprising the steps of:

introducing a gas containing relatively higher hydrogen sulfide concentration to a fragmented permeable mass of particles containing raw oil shale;

reacting hydrogen sulfide in the gas with oxygen in the presence of the raw oil shale to yield gas having a hydrogen sulfide concentration relatively lower than the hydrogen sulfide concentration of the introduced gas; and withdrawing such gas having relatively lower hydrogen sulfide concentration from the fragmented permeable mass.

3. The method of claim 2 in which the hydrogen sulfide is reacted with about one mole of oxygen per two moles of hydrogen sulfide to produce sulfur.

4. The method of claim 2 in which the hydrogen sulfide is reacted with less than one mole of oxygen per two moles of hydrogen sulfide to produce sulfur.

5. The method of claim 2 in which the gas containing relatively higher hydrogen sulfide concentration contains fuel value components, and wherein oil shale contacted by the fuel value components is at a temperature less than the spontaneous ignition temperature of the fuel value components at the conditions at which the oil shale is contacted by the fuel value components.

6. A method of decreasing hydrogen sulfide and total sulfur concentration of gas in a first in situ oil shale retort in a subterranean formation containing oil shale, said first in situ retort containing a fragmented permeable mass of formation particles containing raw oil shale, which comprises the steps of:

introducing gas containing relatively higher hydrogen sulfide and total sulfur concentration into the first retort;

introducing oxygen containing gas into the first retort for reacting oxygen in the oxygen containing gas with hydrogen sulfide in the gas of relatively higher hydrogen sulfide and total sulfur concentration in the presence of raw oil shale in the first retort to yield gas having a hydrogen sulfide and total sulfur concentration relatively lower than the hydrogen sulfide and total sulfur concentration of the introduced gas containing hydrogen sulfide; and withdrawing such gas having a relatively lower hydrogen sulfide and total sulfur concentration from the first retort.

7. The method of claim 6 wherein the step of introducing comprises introducing into the first retort oxygen containing gas providing about one mole of oxygen per two moles of hydrogen sulfide in the gas containing relatively higher hydrogen sulfide concentration.

8. The method of claim 6 in which the gas containing relatively higher hydrogen sulfide concentration comprises off gas from a second in situ oil shale retort, the off gas contains fuel value components, and wherein formation particles in the first retort contacted by the fuel value components are at a temperature less than the spontaneous ignition temperature of the fuel value components at the conditions at which the particles are contacted by the fuel value components.

9. The method of claim 8 wherein the step of introducing comprises introducing into the first retort oxygen containing gas providing about one mole of oxygen per two moles of hydrogen sulfide in the off gas.

10. The method of claim 6 in which the gas containing relatively higher hydrogen sulfide concentration contains fuel value components, and wherein formation particles contacted by the fuel value components in the off gas are at a temperature less than the spontaneous ignition temperature of the fuel value components at the conditions at which the formation particles are contacted by the fuel value components.

11. A method for reducing the hydrogen sulfide and total sulfur concentration of an off gas from an in situ oil shale retort comprising the steps of:

introducing the off gas to a fragmented permeable mass of raw oil shale;

reacting hydrogen sulfide in the off gas with about one mole of oxygen per two moles of hydrogen sulfide in the off gas in the presence of the raw oil shale to produce sulfur and to yield gas having a hydrogen sulfide and total sulfur concentration relatively lower than the hydrogen sulfide and total sulfur concentration of the off gas; and withdrawing such gas having relatively lower hydrogen sulfide and total sulfur concentration from the fragmented permeable mass of oil shale.

12. A method of decreasing hydrogen sulfide concentration of a gas comprising the steps of:

introducing a gas having a first hydrogen sulfide concentration to a fragmented permeable mass of raw oil shale;

reacting hydrogen sulfide in the gas having a first hydrogen sulfide concentration with oxygen in the presence of the raw oil shale to yield gas having a second hydrogen sulfide concentration; and withdrawing such gas having a second hydrogen sulfide concentration from the fragmented permeable mass of raw oil shale, wherein the first hydrogen sulfide concentration is greater than the second hydrogen sulfide concentration.

13. The method of claim 12 in which the hydrogen sulfide is reacted with about one mole of oxygen per two moles of hydrogen sulfide to produce sulfur.

14. The method of claim 12 in which the hydrogen sulfide is reacted with less than one mole of oxygen per two moles of hydrogen sulfide to produce sulfur.

15. A method for reducing the hydrogen sulfide and total sulfur concentration of an off gas from an in situ oil shale retort, the off gas containing particulates and hydrocarbon containing aerosols, comprising the steps of:

introducing such off gas to a fragmented permeable mass of raw oil shale;

reacting hydrogen sulfide in the off gas with oxygen in the presence of the raw oil shale to yield gas having a hydrogen sulfide and total sulfur concentration relatively lower than the hydrogen sulfide and total sulfur concentration of the off gas; and withdrawing such gas having relatively lower hydrogen sulfide and total sulfur concentration from the fragmented permeable mass of oil shale.

16. The method of claim 15 including the step of removing hydrocarbon containing aerosols from the off gas before introducing the off gas to the fragmented permeable mass.

17. The method of claim 16 including the step of removing particulates from the off gas before introducing the off gas to the fragmented permeable mass.

18. The method of claim 15 including the step of removing particulates from the off gas before introducing the off gas to the fragmented permeable mass.

* * * * *